US008814058B2

(12) United States Patent
Danneberg et al.

(10) Patent No.: US 8,814,058 B2
(45) Date of Patent: Aug. 26, 2014

(54) PLASTIC SCREW ANCHOR FOR SECURING A RAIL TO A RAILROAD TIE

(75) Inventors: Erik Danneberg, Zurich (CH); Tilman Peter Ruetzel, Constance (DE); Roland Buda, Radolfzell am Bodesee (DE); Frank Meyer, Stockach (DE)

(73) Assignee: Schwihag AG, Taegerwilen (CH)

( * ) Notice: Subject to any disclaimer, the term of this patent is extended or adjusted under 35 U.S.C. 154(b) by 116 days.

(21) Appl. No.: 13/640,369

(22) PCT Filed: May 25, 2011

(86) PCT No.: PCT/EP2011/002596

§ 371 (c)(1),
(2), (4) Date: Oct. 29, 2012

(87) PCT Pub. No.: WO2011/147568

PCT Pub. Date: Dec. 1, 2011

(65) Prior Publication Data

US 2013/0056545 A1 Mar. 7, 2013

(30) Foreign Application Priority Data

May 26, 2010 (DE) ..... 10 2010 021 505
Nov. 25, 2010 (DE) ..... 10 2010 052 357
May 25, 2011 (DE) ..... 10 2011 103 127

(51) Int. Cl.
*E01B 9/00* (2006.01)
*E01B 9/18* (2006.01)

(52) U.S. Cl.
CPC ..... *E01B 9/18* (2013.01)
USPC ..... 238/377; 238/315; 238/372; 238/373

(58) Field of Classification Search
USPC ..... 238/315, 372, 373, 377, 374
See application file for complete search history.

(56) References Cited

U.S. PATENT DOCUMENTS 1,586,617 A * 6/1926 Etheridge ..... 238/373
4,403,734 A * 9/1983 Gorman ..... 238/372
4,819,869 A * 4/1989 Matlock ..... 238/298
5,085,547 A * 2/1992 Vanotti ..... 411/72

(Continued)

FOREIGN PATENT DOCUMENTS

DE 10148726 A 4/2003
EP 0785308 A 7/1997

*Primary Examiner* — Jason C Smith
(74) *Attorney, Agent, or Firm* — Andrew Wilford

(57) ABSTRACT

The invention relates to a plastic screw plug (6) for attaching a rail to a sleeper, in particular concrete sleeper, having an essentially cylindrical plug body which has at the head end a stem region (7) which preferably adjoins a plug crown (8) toward the bottom, and in the continuation of which stem region (7) has an outer thread (9) with which it can be turned out of or into the sleeper, and is provided with an inner thread (10) underneath the stem region (7) in order to receive a sleeper screw. The intention is to improve such a plastic screw plug, in particular, with regard to its operating properties such as uniform application of force into the sleeper, simpler mounting and replaceability, reduction of the risk of fracturing, and additionally to permit it to be used in a variable way. For this purpose, the stem region (7) has on the inside, in the junction with the inner thread (10), a shoulder (13) which reduces the internal diameter over part of the length of the stem region (7) and extends in a spiral shape over at least part of the circumference.

10 Claims, 5 Drawing Sheets

(56) References Cited

U.S. PATENT DOCUMENTS

| | | | | |
|---|---|---|---|---|
| 5,332,153 | A * | 7/1994 | Leibhard et al. | 238/373 |
| 5,738,278 | A * | 4/1998 | Franz et al. | 238/377 |
| 7,922,102 | B2 * | 4/2011 | Wirthwein et al. | 238/349 |
| 8,434,981 | B2 * | 5/2013 | Bosterling et al. | 411/178 |
| 2009/0001187 | A1 * | 1/2009 | Mahikian | 238/377 |
| 2009/0302126 | A1 * | 12/2009 | Wirthwein et al. | 238/349 |
| 2012/0298765 | A1 * | 11/2012 | Bosterling et al. | 238/315 |
| 2013/0056545 | A1 * | 3/2013 | Danneberg et al. | 238/315 |
| 2013/0228634 | A1 * | 9/2013 | Bosterling et al. | 238/377 |

* cited by examiner

Fig. 3 - Prior Art
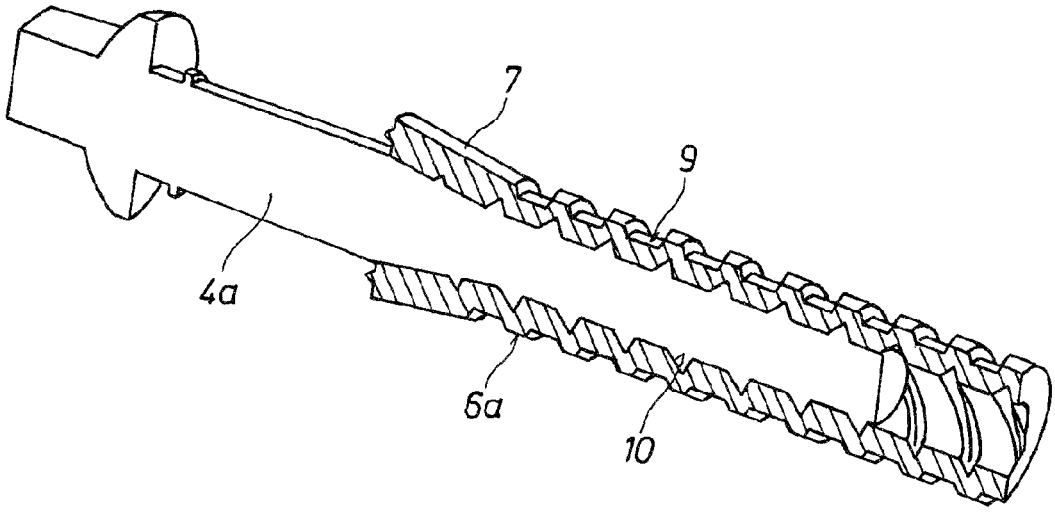
Fig. 4 - Prior Art
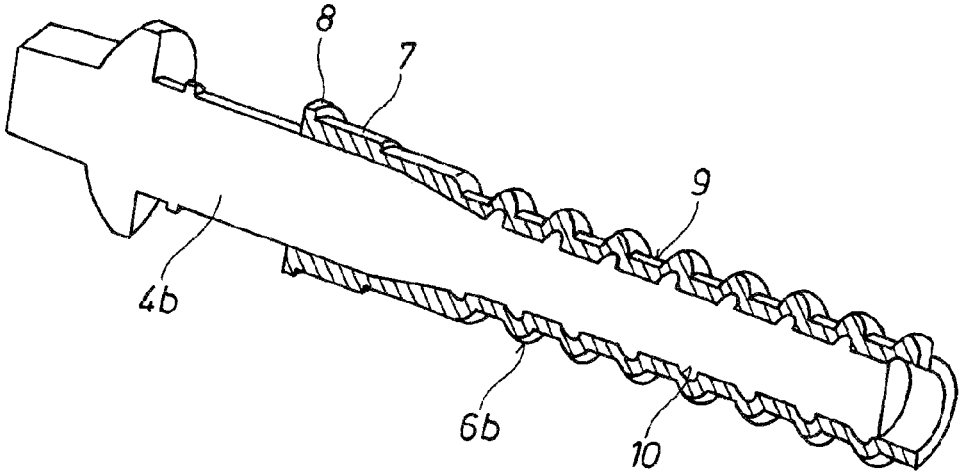

PLASTIC SCREW ANCHOR FOR SECURING A RAIL TO A RAILROAD TIE

CROSS REFERENCE TO RELATED APPLICATIONS

This application is the US-national stage of PCT application PCT/EP2011/002596 filed 25 May 2011, published 1 Dec. 2011 as WO2011/147568, and claiming the priority of German patent application 102010021505.8 itself filed 26 May 2010 and German patent application 102010052357.7 itself filed 25 Nov. 2010.

The invention relates to a plastic screw anchor for securing a rail to a railroad tie, in particular a concrete tie, comprising a generally cylindrical body that has an upper crown with immediately thereunder a shank part and thereunder an external thread allowing the anchor to be unscrewed from or screwed into the railroad tie, and is formed below the shank part with an internal thread for receiving a rail screw.

In current railroad tracks subject to high loads, the rails are laid exclusively on concrete ties and secured by rail fastening systems that are composed of clamping elements (spring clips), rail guide elements (angled guide plates), and a screw anchor combination, a plastic screw anchor being used of the type described above, such as that disclosed in EP 0 785 308 B1. The plastic anchor is produced by injection molding from a high-quality plastic such as polypropylene, polyamide, or polyolefin, in particular HDPE.

The screw/anchor combination constitutes a critical component since it must on the one hand accommodate the high strains of the spring clip (including even the introduction of oscillating forces in the case of highly elastic systems), but must also transmit the forces into the prestressed concrete of the tie in the gentlest possible way. In this regard, it is primarily increased peak stresses that produce cracks in the concrete that can result in the destruction of the concrete tie over the long term.

Two solutions are used in practice, namely, as disclosed in the above-referenced publication, a screw anchor combination first of all that is composed of a round-thread rail screw and a plastic anchor having a corresponding internal thread for round-thread screws. In the lower region of the body, this known plastic screw anchor has a shape that is matched to the external thread of the rail screw, the shape having essentially the same wall thickness, that is sized so that the outside diameter of the anchor is at least 1.05 times, and at most 1.2 times, the inside diameter of the anchor, so the lower region of the body matches the rounded external thread of a rail screw. The thickness further reduced thereby is intended to enable the body to surround the screw like a thin-walled skin. Matching the lower region of the body to the rounded external thread of the rail screw is intended to prevent the risk of cutting into the thin anchor wall when the screw is screwed in, as compared with a sharp-edged thread.

However, the thin-walled construction of the plastic anchor allows forces to be transferred directly from the rail screw to the concrete, and this effect, in particular, results in extreme peak stresses in the concrete in response to impacts or shear forces (transferred from the train wheel through the rail to the fastening system). In addition, unscrewing this type of thin-walled plastic anchor when damaged is possible only with difficulty since the replacement anchor must be of smaller outside dimensions to enable it to be screwed into the "concrete thread" (created when the damaged anchor is unscrewed). A further reduction in the wall thickness, however, produces a significant weakening of the plastic anchor, with the result that replacing it cannot provide lasting reliability.

A second screw anchor combination is composed of a commercially available rail screw with sharp thread and a plastic anchor with an internal thread exclusively for sharp-thread screws. Although the plastic anchors used here are thicker-walled, screwing in the rail screw still requires special care to engage the screwthread in the thread of the anchor. If this does not happen, the rail screw can cut a new thread into the plastic anchor next to the existing sharp screwthread, and this results in significantly weakening the plastic anchor and in its destruction over the long term.

The object of this invention is therefore to create a plastic screw anchor of the above type that does not have the mentioned disadvantages and that, in particular, is improved in terms of its operational properties such as uniform introduction of force into the tie, simpler assembly and replaceability, reduction in the risk crack formation, and is furthermore versatility in use.

This object is achieved according to the invention by an approach where the shank part is formed where it joins the internal thread with an inwardly projecting ridge that extends as a spiral angularly at least around part of the shank part. This ridge, which can be approximately 15 mm long for a length of the shank part measuring about 40 mm, somewhat restricts the entry for a rail screw, and enables the rail screw to be precentered immediately before its screwthread enters the internal thread of the anchor. The spiral shape of the ridge like the following turns of the thread supports the rail screw so it cannot to cut a separate new thread next to the internal thread of the anchor. The risk of damaging the anchor by improperly placing or starting the rail screw is prevented especially in cases where sharp-thread screws are used. The situation can no longer arise where a sharp-thread screw cuts a new thread, which would necessitate reverse turning and restarting the rail screw.

The plastic anchor according to the invention is thus suitable for sharp-thread rail screws and for round-thread rail screws. Given the fact that screws are unavoidably switched during track construction, because track-construction companies and railroad companies often keep many thousands of these two screw types in stock, the anchor cannot be damaged and assembly can be effected without modification.

An advantageous proposal of the invention provides that the leading flanks of the internal thread of the anchor in the screw insertion direction and the anchor's trailing flanks have different helix angles and transition into each other with different radii where they merge. This enables a thread geometry to be optimized in order to receive rail screws with either a round or a sharp thread, and with the same fatigue strength and bracing force. The helix angles that produce this optimization for the leading and trailing flanks can be 70° or 45° respectively, and the transition radii can be 1 mm or 1.5 mm.

In a preferred embodiment of the invention, the shank part is provided with an external screwthread. This screwthread, which is in addition to the external thread already present, is provided between—when present—an anchor crown and the spiral-shaped ridge that defines the screw insertion geometry for precentering, ensures—and numerous tests have confirmed this—that any extraction motion is prevented even in response to significantly increased tightening torque, and the anchor retains the ability to be unscrewed. This is because despite the regulation specifying 250 Nm, values ranging from around 900 to 1000 Nm frequently occur in practice due to improperly adjusted screw insertion machines such that the shank part stretches upward and the anchor crown is pulled out beyond the surface of the concrete tie by a few tenths of a millimeter.

If preferably the turns of the external screwthread of the plastic screw anchor are saw-tooth-shaped, with a shallow angle sloping inward from the thread crests in the screw insertion direction and with an identically sized pitch a having, for example, an inclination angle of 18° and a pitch of approximately 12.5 mm, this distributes the stress and thus prevents radial cracks in the concrete tie, thereby preventing the ties from breaking open in the longitudinal direction of the steel reinforcement. This is because the saw-tooth shape keeps the spreading effect as small as possible. In addition, it is possible to achieve a steep angle for the trailing upper flanks of the external thread. When a pull-out force comes into effect, the anchor is thus supported only in a short region of the thread contour. A large portion of the support region, i.e. the upper flanks of the external thread, is thus made with a steep angle.

In an advantageous embodiment of the invention, the body is of large thickness with a ratio between the minor diameter of the internal thread and the external thread that is 0.67, where preferably the minor diameter is 15 to 20 mm and the outside diameter is 30 to 35 mm. The thickness of the anchor wall that is significantly larger when compared to the anchors that are typically used in the railroad industry allows for large force-transmitting surfaces and results in reducing the stresses within the entire rail fastening system. Minor diameters of 17 to 18 mm and outside diameters of 31 to 32 mm have been found to be especially well-suited; i.e. the remaining wall thickness in this embodiment ranges between 13 and 15 mm.

In further advantageous embodiments of the invention, the internal thread has a different pitch than the thread of the rail screw, and is optionally provided with at least one turn whose pitch that differs from pitch the other turns. Providing a non-identical pitch, or at least a change in the pitch of the internal thread of the anchor, allows introduction of the main force to be concentrated in the lower region of the anchor. This contributes to improving the load situation for the concrete tie and reduces the risk of crack formation in the region of the anchor crown.

In one proposal of the invention, the overall length of the anchor from the crown to the opposite end measures at least 135 to 140 mm. These are typical commercial dimensions, although the approach within the scope of the invention extends the anchor beyond this commercially typical size so as to displace the introduction of force into a noncritical region of the concrete tie.

Another preferred embodiment of the invention provides an approach whereby the anchor crown is tapered in the screw insertion direction. This approximately 8° taper of the anchor crown is especially effective when the anchor is positioned by an anchor holder in the mold when the concrete tie is poured. This then prevents the highly fluid concrete surface water (laitance) from penetrating into the anchor. A sealing effect is thus achieved. When the anchor is then permanently screwed into the tie, the outer edge of the anchor crown of the anchor, which is injection-molded from an elastic material, acts like a sealing lip.

Additional features and details of the invention are revealed in the claims and the following description of embodiments of the invention that are shown in the drawing. Therein:

FIG. 3 is a perspective view partly in longitudinal section through a conventional rail screw with a sharp thread that is screwed into a plastic screw anchor for a sharp thread as found in the prior art;

FIG. 4 is a perspective view partly in longitudinal section through a rail screw with a round thread that is screwed into a plastic screw anchor for a round thread as found in the prior art;

Figure 1:
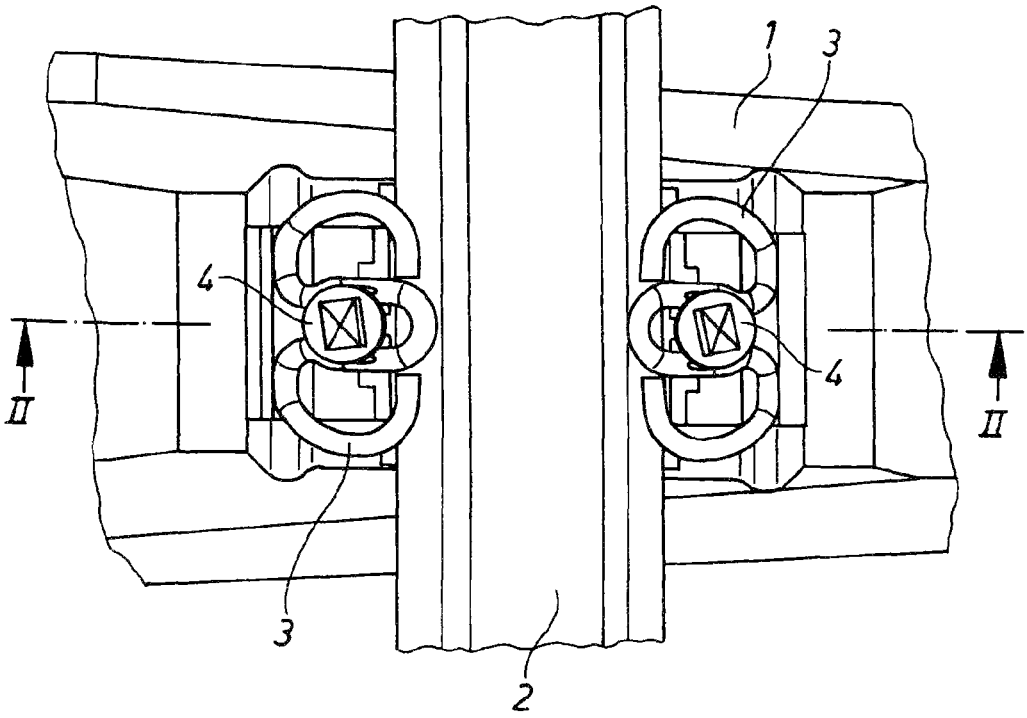
FIG. 1 is a top view of part of a track system showing the attachment of a rail to a concrete tie.
Figure 2:
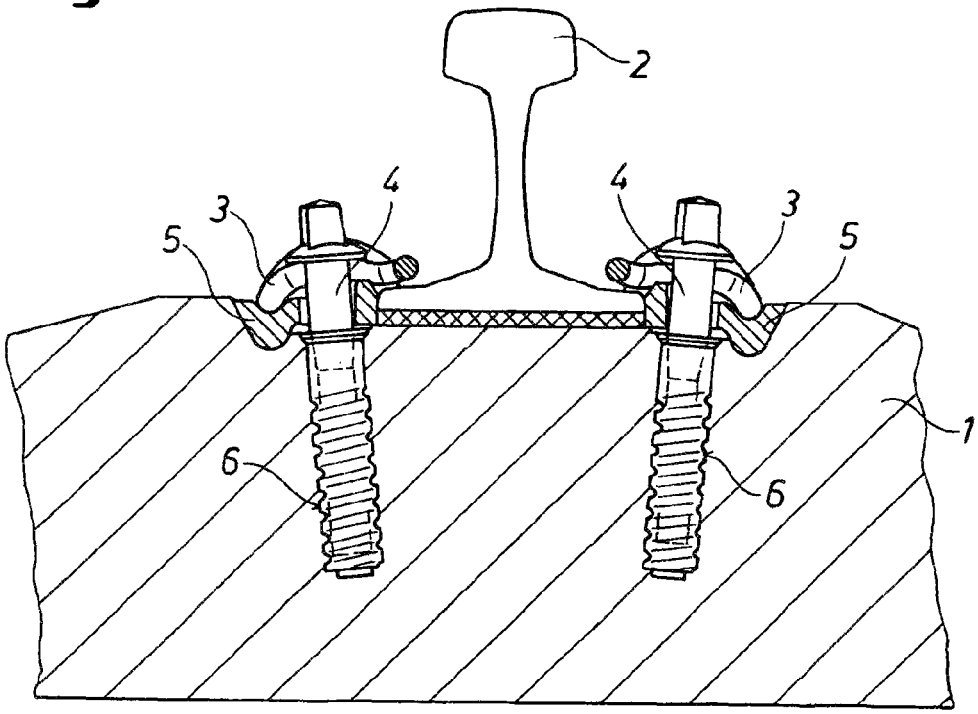
FIG. 2 is a section along line II-II in FIG. 1.

FIGS. 1 and 2 show a prior-art rail attachment system in which a stock rail 2 laid on a concrete tie 1 is secured in place by spring clips 3 and by rail screws 4 that pass through angled guide plates 5 and are screwed into plastic screw anchors 6 set in the concrete tie 1 while passing through the center loops of the spring clips 3.

Either sharp-thread rail screws 4*a* (see FIG. 3) or round-thread rail screws 4*b* (see FIG. 4) are used here with which correspondingly matched sharp-thread plastic screw anchors 6*a* (see FIG. 3) or round-thread plastic screw anchors 6*b* are employed. The plastic screw anchors 6, or 6*a*, 6*b*, have an essentially cylindrical body having an upper shank part 7, optionally with an anchor crown 8 (see FIG. 4), and both a saw-tooth-shaped external thread 9 and an internal thread 10 in the extension thereof.

In both embodiments of a plastic screw anchor 6 shown in FIGS. 5 through 7, or 8 through 12, the body has very thick walls, thereby enabling this body to plastically deform within the concrete tie 1. The ratio of the minor diameter Di of its internal thread 9 to the outside diameter Da of the body is ≤0.67 (see FIG. 12). The turns 9*a* of the external thread 9 are saw-tooth-shaped, and have a shallow flank angle 12 of about 18° extending inward from the thread crests 9*b* in a screw-insertion direction 11 (see arrows in FIG. 5, and also 8 and 9), and have the same pitch P of approximately 12.5 mm for the leading lower flanks (see FIGS. 7 and 12), while the trailing upper flanks have a steeper angle.

In both variants of the anchor, the shank part 7 merges at a spiral-shaped ridge 13 into the internal thread 10 such that the inside diameter of the shank part 7 undergoes a reduction in diameter over a distance of, for example, 15 mm for a shank length of 40 mm, with the result that the spiral ridge is the equivalent of an insertion centering means in front of the actual internal thread. The rail screw 4 engages and positions or aligns itself in front of internal thread 10 in such a way that the sharp-thread rail screw 4*a* cannot cut its own separate thread.

In addition to the optimized screw insertion geometry to prevent faulty insertion of sharp-thread rail screws, plastic screw anchors 6 furthermore have optimized ridge geometries for their internal thread 10. Each of the leading flanks in the screw insertion direction 11 has a helix angle β of approximately 70°, while the respective trailing flanks have a helix angle α of approximately 45° (see FIGS. 7 and 12). At the locations of the thread turns of the internal thread 10 where the leading and trailing flanks transition into each other with different radii R1 or R1.5, i.e. by 1 mm and 1.5 mm. As is also shown in FIG. 7, the thread crests 9*b* of the turns 9*a* of the external thread 9, which are concentric and have a saw-tooth-shape, are provided with different transition radii R2 (2 mm) and R1 (1 mm).

Figure 5:
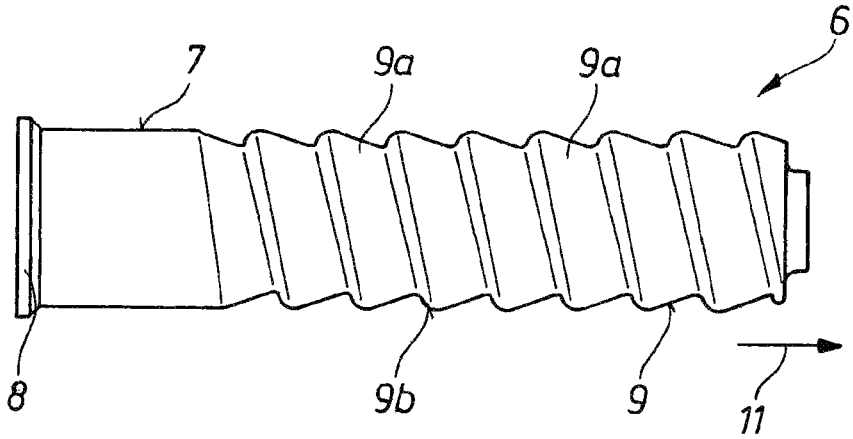
FIG. 5 is a longitudinal side view of a first embodiment of a plastic screw anchor according to the invention that has an optimized internal screwthread geometry to be used both for rail screws with round and also with sharp threads.
Figure 6:
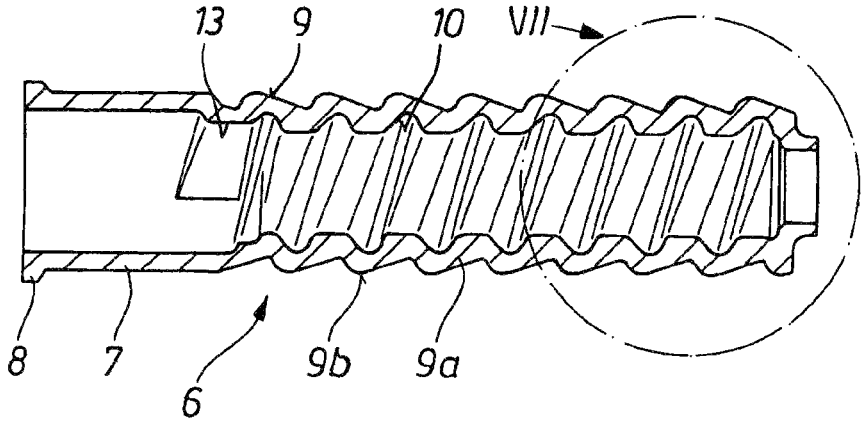
FIG. 6 shows a longitudinal section through the plastic screw anchor of FIG. 5.
Figure 7:
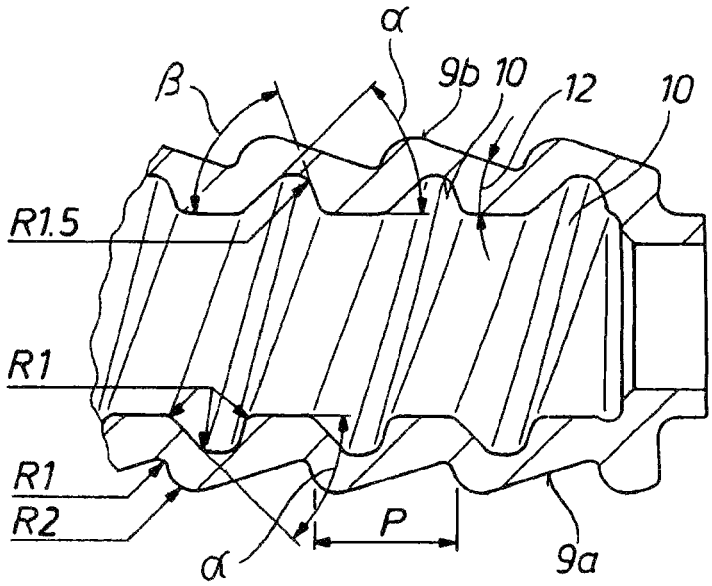
FIG. 7 is an enlarged detail of the front end region of the anchor identified in FIG. 6 by a dot-dash circle.
Figure 8:
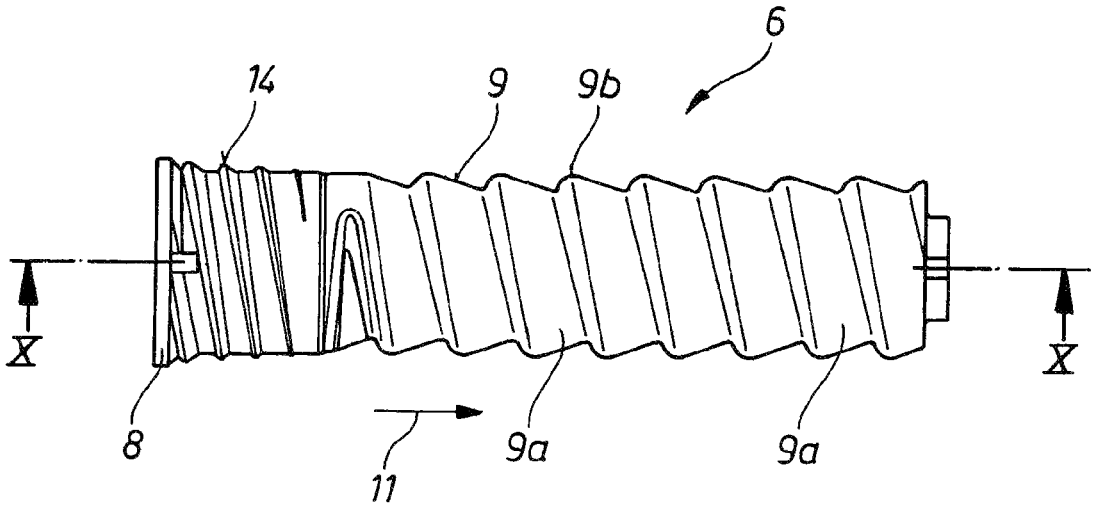
FIG. 8 is a longitudinal view of another embodiment of a plastic screw anchor according to the invention to be used for rail screws with both round and sharp threads.
Figure 9:
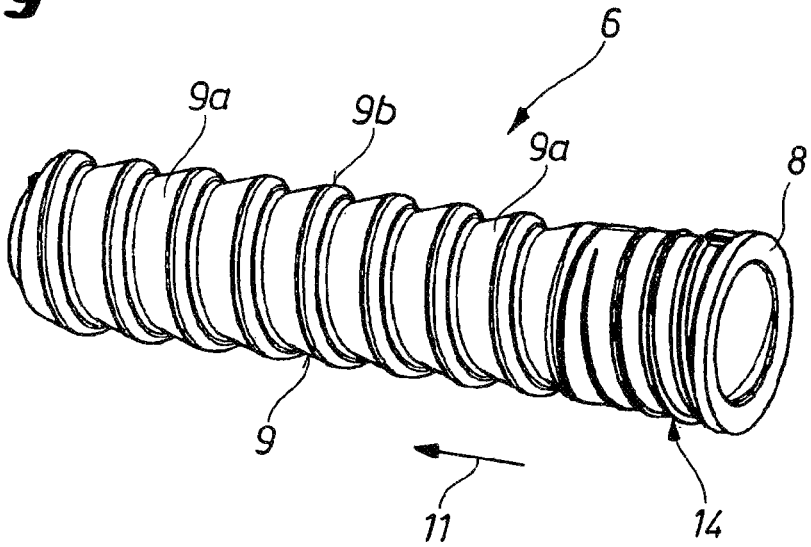
FIG. 9 is a longitudinal perspective view of the plastic screw anchor of FIG. 8.
Figure 10:
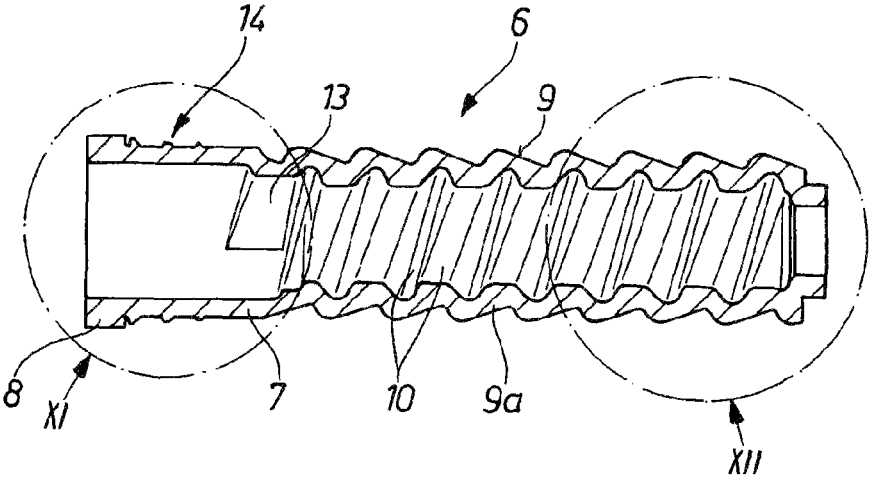
FIG. 10 is a section along line X-X of FIG. 8.
Figure 11:
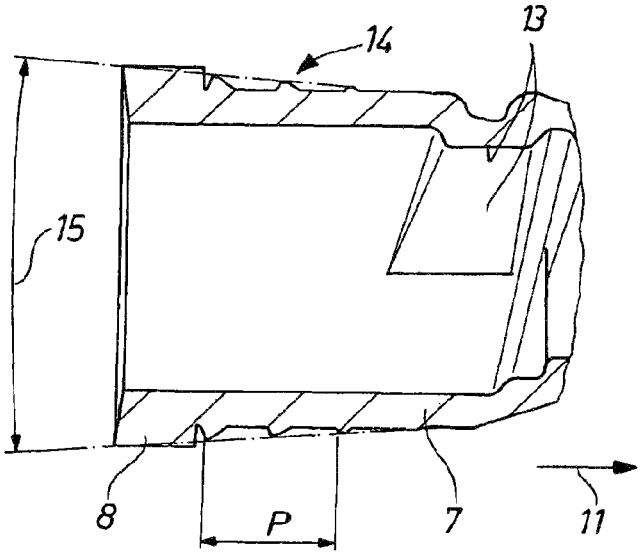
FIG. 11 is an enlarged detail of the upper region of the anchor indicated by a dot-dash circle in FIG. 10.
Figure 12:
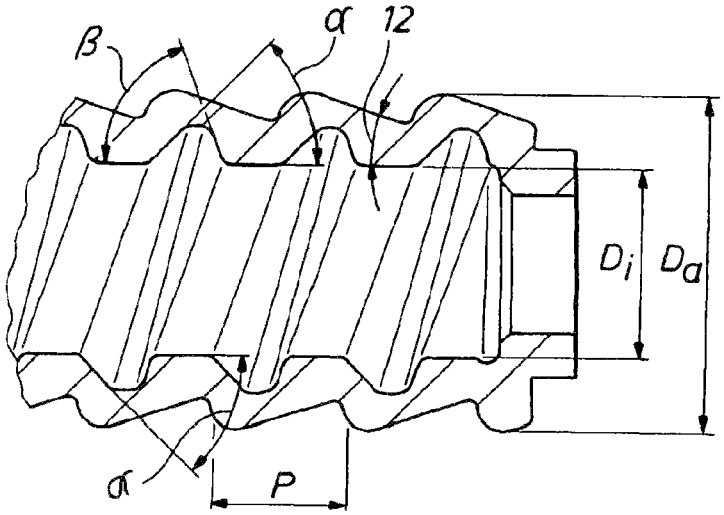
FIG. 12 is an enlarged view of the front region of the anchor indicated by a dot-dash circle in FIG. 10.

The use of plastic screw anchor 6 of FIGS. 8 through 12 differs from that of FIGS. 5 through 7 in that the shank part 7 is also provided with a thread-like outer profile 14 with a large pitch P of around 12.5 mm, and the anchor crown 8 is at an angle 15 of around 8° (see FIG. 11) in the screw insertion direction 11.

LIST OF REFERENCE NUMERALS

1 concrete tie
2 stock rail
3 spring clip
4 rail screw
4*a* sharp-thread rail screw
4*b* round-thread rail screw
5 angled guide plate
6 plastic screw anchor
6*a* sharp-thread plastic screw anchor
6*b* round-thread plastic screw anchor
7 shank part
8 anchor crown
9 external thread
9*a* thread turn
9*b* thread crest
10 internal thread
11 screw insertion direction
12 inclination angle
13 spiral ridge
14 thread-like outer profile
15 taper angle
Di minor diameter of the internal thread
Da outside diameter of the body
P pitch
R1 rounding radius
R1.5 rounding radius
R2 rounding radius
α helix angle (trailing flank)
β helix angle (leading flank)

The invention claimed is:

1. A plastic screw anchor for securing a rail to a railroad tie, the anchor comprising a generally cylindrical body that has an upper crown with immediately thereunder a shank part and thereunder an external thread allowing the anchor to be unscrewed from or screwed into the railroad tie, the body formed below the shank part with an internal thread for receiving a rail screw and being formed where the body joins the internal thread with an inwardly projecting ridge that extends as a spiral angularly at least around part of the shank part.

2. The plastic screw anchor according to claim 1, wherein leading and trailing flanks of the internal thread of the plastic anchor in the screw insertion direction each have a different helix angle and transition into each other with different radii where they merge.

3. The plastic screw anchor according to claim 1, wherein the shank part is provided with an external screwthread.

4. The plastic screw anchor according to claim 1, wherein the turns of the external thread are saw-tooth-shaped, have a shallow angle sloping inward from the thread crests in a screw insertion direction, the leading lower flanks having the same pitch, the trailing upper flanks having a steeper angle.

5. The plastic screw anchor according to claim 1, wherein the body is of a large thickness having a ratio for the minor diameter of the internal thread to the outside diameter of ≤0.67, the minor diameter being 15 to 20 mm, while the outside diameter is 30 to 35 mm.

6. The plastic screw anchor according to claim 1, wherein the internal thread has a pitch different from that of the thread of the rail screw.

7. The plastic screw anchor according to claim 1, wherein the internal thread is provided with at least one turn of a pitch that differs from the pitch of the remaining turns.

8. The plastic screw anchor according to claim 1, wherein its overall length measures at least 135 to 140 mm.

9. The plastic screw anchor according to claim 1, wherein the anchor crown is tapered in a screw insertion direction.

10. A screw anchor unitarily formed of plastic as a generally tubular body extending along an axis and formed with:

a generally cylindrical upper shank part having a smooth and generally cylindrical inner surface;

a lower part extending downward from an end of the shank part and formed with an internal screwthread adapted to receive a screw and an external screwthread; and a spiral-shaped internally ridge forming an extension of the internal screwthread where the lower part joins the upper part.

* * * * *